United States Patent [19]

Gebert

[11] Patent Number: 4,961,577

[45] Date of Patent: Oct. 9, 1990

[54] ORBITAL SPINNER

[76] Inventor: Paul Gebert, 4 Benham Cir., Cartersville, Ga. 30120

[21] Appl. No.: 371,922

[22] Filed: Jun. 27, 1989

[51] Int. Cl.[5] ..... A63B 67/14

[52] U.S. Cl. ..... 275/109

[58] Field of Search ..... 273/108, 109, 115, 112

[56] References Cited

U.S. PATENT DOCUMENTS

| | | | |
|---|---|---|---|
| 84,865 | 12/1868 | Douglas | 273/108 |
| 713,027 | 11/1902 | Marais | 273/113 |
| 2,220,823 | 11/1940 | McKeown | 273/113 |
| 2,971,288 | 2/1961 | Gill | 273/112 |
| 3,674,271 | 7/1972 | DeGelder et al. | 273/115 |
| 3,702,191 | 11/1972 | Zilius et al. | 273/112 |
| 3,933,356 | 1/1976 | Torgow | 273/109 |

*Primary Examiner*—Randall L. Green

*Assistant Examiner*—Gary Jackson

*Attorney, Agent, or Firm*—John L. James

[57] ABSTRACT

An apparatus and method for playing a game of skill has a base member with a surface and a vertical axis. An orbital pathway is formed on the base surface, and a handle is attached to the base. A top member has a vertical axis and a spindle that extends along the vertical axis. The spindle rides in the orbital pathway as the top member rotates about the vertical axis of the top member. The top member travels along the orbital pathway making an orbit about the vertical axis of the base member each time the top member passes the handle. A game played with the apparatus has as its object keeping the top member spinning to obtain the highest number of orbits. There may be more than one orbital pathway and the top member may be hopped from one pathway to another to increase speed and total number of orbits.

10 Claims, 2 Drawing Sheets

ORBITAL SPINNER

CROSS REFERENCE TO RELATED APPLICATIONS

This application is related to application Ser. No. 07/202,556, SPINNING TOP AND PROJECTILE GAME, filed herewith, and application Ser. No. 07/371,924, ROVING SPINNING TOP PUZZLE, filed herewith, by the present inventor.

TECHNICAL FIELD

This invention relates generally to amusement devices, and more particularly relates to a spinning top apparatus and method for playing a game that challenges coordination and reflex action of the player.

BACKGROUND OF THE INVENTION

Amusement devices and games are enjoyed by people all over the world. Virtually every person uses some sort of amusement device or plays with a toy or game. Unfortunately, many games require two or more persons to play and may take hours to complete. It is desirable to have a game that can be played quickly and can be played by a single person as well as by a group of persons.

A problem with some games is that the games include an element of chance. Some games, for example, introduce an element of chance with dice or cards so that the outcome is skewed by the roll of the dice or the lay of the cards. Such an element of chance diminishes the skill level required for the games. It is highly desirable to have a game that does not include an element of chance and relies purely on the skill and reflexes of the player.

The number of games available for handicapped persons who are confined to a wheelchair is limited. Some games cannot be enjoyed by persons who have limited use of their legs, are hearing impaired, or mentally impaired. Also, games requiring the use of the legs are difficult, if not impossible, to play in confined areas such as a bus, train or airplane. It is therefore desirable to have a game that can be enjoyed by adults, children and handicapped persons, and can be played when traveling by automobile, bus, train or airplane.

There are many cafes, bars and lounges that are frequented by thousands of persons each day to eat, listen to music, watch wide screen television, rendezvous, and socialize. Bars, cafes and lounges are often convenient waiting places for travelers between flights and for business people between meetings. It will be appreciated that it would be highly desirable to have a game that could be played while people are waiting at a bar or in a cafe that does not tax the mental capacity of the player so that the game does not interfere with other mental activities.

SUMMARY OF THE INVENTION

The present invention is directed to overcoming one or more of the problems set forth above. Briefly summarized, according to one aspect of the invention, a game of skill and coordination has a base member with a surface and a vertical axis. An orbital pathway is positioned on the surface of the base, and a handle is attached to the base. A top member has a vertical axis and a spindle extending along the vertical axis that rides in the orbital pathway as the top member rotates about the vertical axis of the top member.

According to another aspect of the invention, a method for playing a game includes holding a base member having a handle and an orbital pathway in one hand, spinning a top member on the orbital pathway, imparting reciprocating motion to the base member causing the top member to ride along the orbital pathway increasing rotational speed as it travels along said orbital pathway, and counting the number of times the top member passes the handle as the top member travels along the orbital pathway.

The present invention uses equipment that is simple in both construction and operation, and is easily transported in a pocket or purse so that the game can be played at any time and anywhere. Because the equipment is simple, the game can be enjoyed by handicapped persons and can be played when traveling by automobile, bus, train or airplane.

The game can be played quickly and can be played by a single person as well as by a group of persons. It is therefore a suitable game for playing while waiting in a cafe, bar, restaurant or lounge. It is also ideally suited for public waiting areas in airports and the like.

The game relies purely on the skill of the player and does not include an element of chance. It is therefore a game that can be used in tournaments and other events that require or highlight player skill.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figures 2, 3, 4:
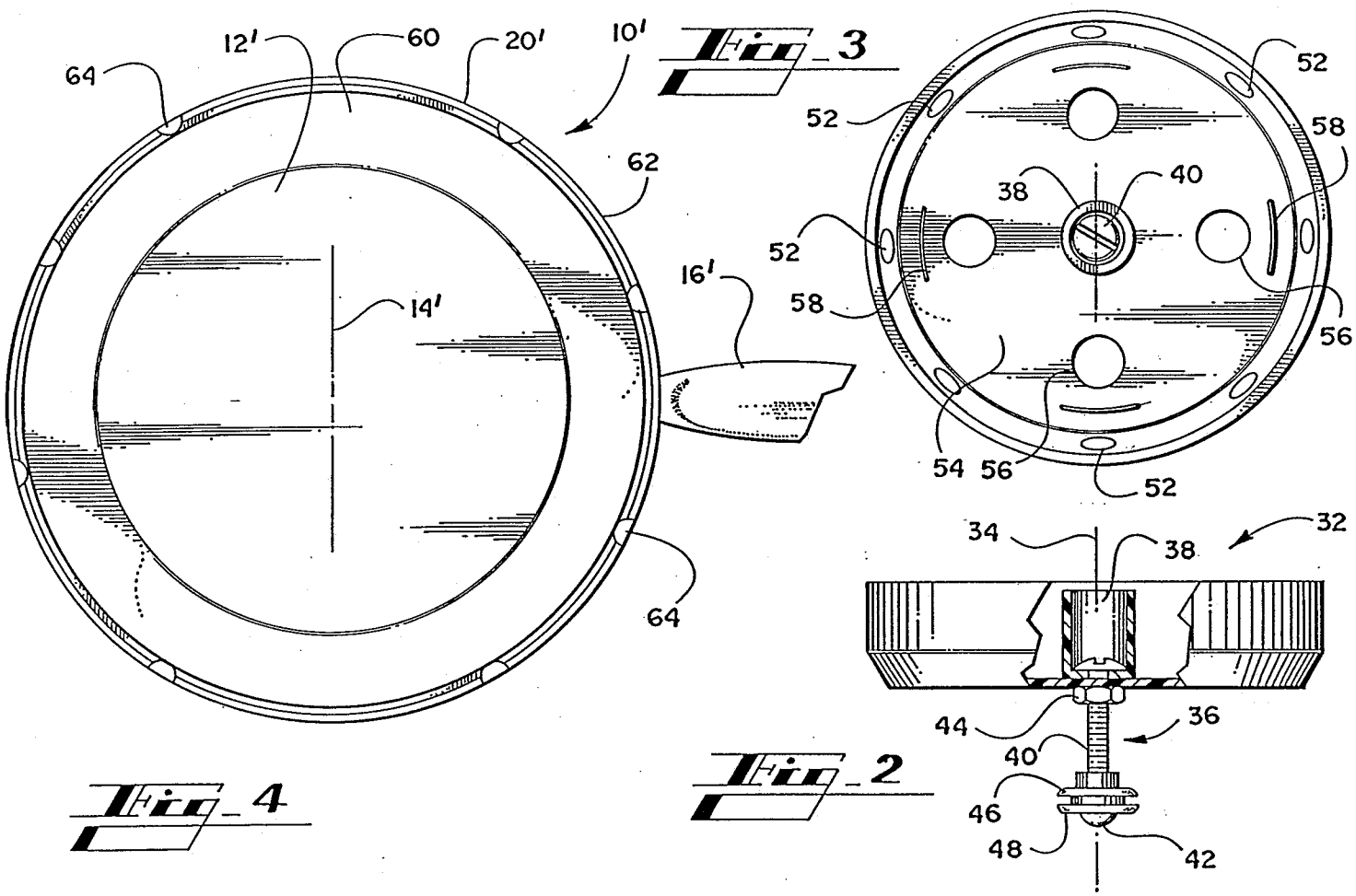
FIG. 2 is a diagrammatic side view of a top member of a spinning apparatus with sections cut away to reveal hidden members.
FIG. 3 is a top view of the top member illustrated in FIG. 2.
FIG. 4 is a top view similar to FIG. 1*a* but illustrating another embodiment.

Referring now to the drawings, in which like numerals indicate like elements throughout the several figures, FIGS. 1–3 illustrate an apparatus for playing a game of skill and coordination. In FIG. 1, the apparatus includes a base member 10 that has a surface 12 and a vertical axis 14 that extends perpendicular to the surface 12 of the base member 10. A handle 16 is attached to the base member 10. The base member 10 has an upturned edge portion 18 about its periphery defining an orbital pathway 20 on the base member 10. The orbital pathway 20 is the outermost orbital pathway.

A dividing member 22 is positioned on the base member 10 and separates the outer orbital pathway 20 from a second inner orbital pathway 24. A second dividing member 26 defines a third orbital pathway 28. The dividing members 22, 26 are preferably circular members with the diameter of the first dividing member 22 being larger than the diameter of the second dividing member 26. Accordingly, the first orbital pathway 20 is larger than the second orbital pathway 24, and the second orbital pathway 24 is larger than the third orbital pathway 28.

The dividing member 26 may be a cup-like structure affixed to the base 10 with the rim of the cup dividing the surface 12 of the base member 10 into the innermost orbital pathway 28 and the intermediate orbital pathway 24. For ease of use, the inner orbital pathway 28 may be colored red, the intermediate orbital pathway 24 may be colored blue, and the outer most orbital pathway 20 may be colored silver.

Figures 1A, 1B:
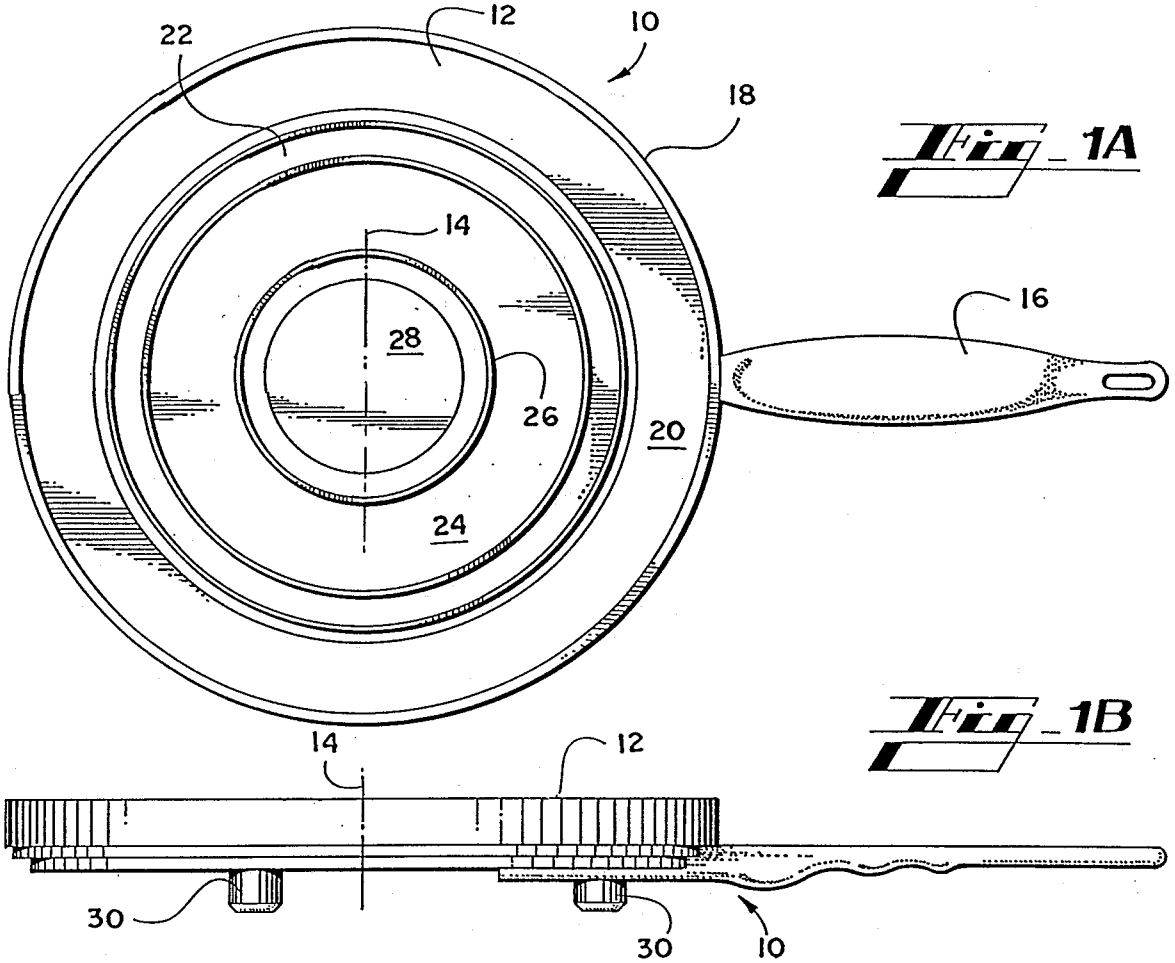
FIG. 1*a* is a top view of a preferred embodiment of a base member of a spinning apparatus for playing a game of coordination and reflex action according to the present invention.
FIG. 1*b* is a side view of the base member illustrated in FIG. 1*a*.

Referring to FIG. 1*b* the base member 10 has a plurality of legs 30 positioned on the bottom side thereof to support the orbital pathways 20, 24, 28 on the surface 12 during use. While the base member can be used without the supporting legs 30, the legs 30 help stabilize the surface 12 and compensate for uneven surfaces that may be used. The legs 30 are particularly useful when the apparatus is used outside where the terrain is less than level.

Referring to FIG. 2, the apparatus has a top member 32 with a vertically extending axis 34. A spindle 36 extends along the vertical axis 34 and has a size and configuration sufficient for riding in one of the orbital pathways 20, 24, 28 of the base member 10 as the top member 32 rotates about its vertical axis 34. When spun, the top member 32 travels along the orbital pathway making an orbit about the vertical axis 14 of the base member 10 each time the top member 32 passes the handle 16. The speed at which the top member 32 rotates increases in response to circular motion of the base member 10 about its vertical axis 14. The speed at which the top member 32 rotates also increases in response to reciprocating movement of the handle 16 of the base member 10.

Still referring to FIG. 2, the spindle 36 includes a hollow cylindrical member 38 that is open on one end and has an opening in the other end through which a shaft 40 of the spindle assembly 36 extends. The shaft 40 is preferably a threaded member which extends through the opening in the hollow member 38, an opening in the top member 32, and terminates in a rounded end portion 42. A nut 44 threaded on the shaft 40 secures the cylindrical member 38 and top member 32 together so that the cylindrical member 38 and top member 32 move together as a unit. A stop nut 46 is threaded onto the shaft 40 a preselected distance and a grommet 48 is placed on the shaft 40 between the stop nut 46 and the rounded end portion 42, leaving the rounded end portion 42 exposed. The height of the grommet 48 on the shaft 40 is sufficient to cause the grommet 48 to make abutting contact with the upturned edge portion 18 of the base member 10 and with the orbital pathway dividers 22, 26.

Alternatively, the end of the spindle shaft 40 may be tapered or pointed instead of rounded. Preferably, the shaft 40 is constructed of a low friction material, such as nylon for example, although other synthetic materials and metal can be used. Nylon, however, introduces less friction and is believed to be the better material for construction of the spindle assembly 36. The other components may be constructed either of metal or plastic. Plastic materials have the advantage of being easily shaped and machined, and can be molded in various decorative shapes and patterns.

Referring now to FIGS. 2–3, the top member 32 has a tapered sidewall 50 with a plurality of openings 52 in the sidewall 50. The bottom 54 of the top member 32 also has a plurality of circular openings 56. There are also a number of arcuate ridges 58 that are decorative and provide a visual impact when the top member 32 rotates about its axis 34 during use.

Referring to FIG. 4, another embodiment of a base member 10' is illustrated that has a handle 16' and a surface 12'. The base member 10' has an orbital pathway 20'. The orbital pathway 20' has a surface 50 thereon and has a lip 62 protruding therefrom extending parallel to the surface 12' of the base member 10'. A plurality of tabs 64 are formed on the base member 10' and extend parallel to the surface 12' and fit over the lip 62 to hold the orbital pathway 20' in position on the base member 10'. The surface 60 of the orbital pathway 20' preferably has a channel shaped cross section to help retain the top member 32 as the top member 32 travels about the pathway 20'. The dividing members 22, 26 (FIG. 1*a*) can also have similar surfaces thereon so that the top member 32 can travel thereon and therein. The orbital pathway 20' is preferably mounted on bearings and is rotatable about the vertical axis 14' of the base member 10'.

It will now be appreciated that there has been disclosed an apparatus and method for playing a game that challenges the coordination and reflexes of the player. A single person can play the game with the apparatus according to the method of the present invention. The game can be played quickly by one person, and can also be played by a group of persons and groups may compete against one another.

Unlike some games that depend on the luck of the player, the present invention does not include an element of chance and relies purely on the skill and reflexes of the player. The equipment required to play is transportable so that the game can be played at any time and anywhere. The game can be enjoyed by adults, children and handicapped persons and can be played when traveling by automobile, bus, train or airplane. It can also be played while waiting at a bar or in a cafe without taxing the mental capacity of the player so that it does not interfere with other mental activities.

The apparatus includes a base member 10 and a top member 32 that rotates about its axis 34 and travels in a pathway formed on the base member 10. The base member 10 has a handle 16 to impart reciprocating motion to the base member 10 and also to rotate the base member 10 about its axis 14. A method for play comprises holding the base member 10 in one hand, spinning the top member 32 and placing the top member 32 in one of the orbital pathways 20, 24, 28. One object of the game is to have the top member 32 make as many complete trips around the orbital pathway as possible before the top member 32 ceases to spin. The faster the top member 32 rotates about its own axis 34 and the faster the top member 32 travels about axis 14 of the base member 10, the longer the top member 32 will spin and the more complete trips it will make. The speed of rotation about its axis and the rate of travel about the pathway is increased by placing the top member 32 in one of the orbital pathways and reciprocating the handle 16.

Another object of the game is to attain the maximum speed which can be achieved by keeping the top member in one pathway, or, while the top member is spinning, manipulating the base member 10 to hop or skip the top member from one orbital pathway to another. It will be appreciated that a given amount of movement of the handle will cause speed to vary depending upon the diameter of the orbital pathway the top member is riding on at the time. The game can be played by one person seeking to increase previous scores or to attain a certain number of revolutions. The game can also be played by two or more persons competing against one another. When competing, the top member may be kept in one orbit, blue for example, then repeated for other orbits with the scores being added for a total. It is also possible to determine for a particular player which orbit is the most difficult and to assign players a handicap, as in golf and some other sports.

While the invention has been described with particular reference to the preferred embodiments, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

What is claimed is:

1. An apparatus, comprising:
a base member having a surface;
an orbital pathway on said surface of said base member and being rotatable relative to said base member;
a handle attached to said base;
a rotatable top member; and
a spindle attached to said top member and extending perpendicularly thereto and being of a size and configuration sufficient for riding in said orbital pathway as said top member rotates, the speed at which said top member rotates increasing in response to reciprocating movement of said handle.

2. An apparatus, as set forth in claim 1, wherein said top member travels along said orbital pathway making an orbit each time said top member passes said handle.

3. An apparatus, as set forth in claim 1, wherein the speed at which said top member rotates increases in response to circular motion of said base member.

4. An apparatus, as set forth in claim 1, wherein said orbital pathway has a surface with a channel formed therein.

5. An apparatus, as set forth in claim 1, including:
an upturned edge portion on said base member; and
an inner orbital pathway member on said base member, said orbital pathway lying between said upturned edge portion of said base member and said inner orbital pathway member.

6. An apparatus, as set forth in claim 5, including a dividing member positioned on said base member between said upturned edge portion of said base and said inner orbital pathway dividing said orbital pathway into a first orbital pathway and a second orbital pathway.

7. An apparatus, as set forth in claim 5, wherein said inner orbital pathway member defines an inner orbital pathway smaller than said orbital pathway lying between said upturned edge portion of said base and said inner orbital pathway member.

8. An apparatus, as set forth in claim 1, including:
an upturned outer edge on said orbital pathway; and
a grommet attached to said spindle, said grommet abutting said upturned outer edge of said orbital pathway as said top member spins and travels about said orbital pathway.

9. An apparatus, as set forth in claim 1, wherein said spindle has a rounded end.

10. An apparatus, as set forth in claim 1, wherein said spindle has a tapered end.

* * * * *